US009791157B2

(12) United States Patent
Martini

(10) Patent No.: US 9,791,157 B2
(45) Date of Patent: Oct. 17, 2017

(54) OVEN PANEL

(71) Applicant: MA.TI.KA. S.R.L., Milan (IT)

(72) Inventor: Oscar Martini, Borgoricco (IT)

(73) Assignee: MA.TI.KA. S.R.L., Milan (IT)

( * ) Notice: Subject to any disclaimer, the term of this patent is extended or adjusted under 35 U.S.C. 154(b) by 116 days.

(21) Appl. No.: 14/438,845

(22) PCT Filed: Nov. 4, 2013

(86) PCT No.: PCT/IB2013/059878
§ 371 (c)(1),
(2) Date: Apr. 27, 2015

(87) PCT Pub. No.: WO2014/068533
PCT Pub. Date: May 8, 2014

(65) Prior Publication Data

US 2015/0253016 A1 Sep. 10, 2015

(30) Foreign Application Priority Data

Nov. 5, 2012 (IT) ..... MI2012A1879

(51) Int. Cl.
*F24C 15/32* (2006.01)

(52) U.S. Cl.
CPC ..... *F24C 15/322* (2013.01)

(58) Field of Classification Search
CPC ..... F24C 15/32
USPC ..... 126/21 A
See application file for complete search history.

(56) References Cited

U.S. PATENT DOCUMENTS 5,336,867 A * 8/1994 Miller ..... F24C 15/322 126/21 A
5,786,567 A * 7/1998 Wang ..... F24C 15/322 126/21 A
2003/0111069 A1 6/2003 Austin et al.

FOREIGN PATENT DOCUMENTS

| | | | |
|---|---|---|---|
| DE | 102004047993 | A1 | 4/2006 |
| EP | 1467154 | A2 | 10/2004 |
| EP | 1543754 | A1 | 6/2005 |
| FR | 2797682 | A1 | 2/2001 |
| WO | 2009079728 | A2 | 7/2009 |

OTHER PUBLICATIONS

International Search Report and Written Opinion mailed Feb. 24, 2014 for PCT/IB2013/059878 to MA.TI.KA. S.R.L. filed Nov. 4, 2013.

* cited by examiner

*Primary Examiner* — Avinash Savani
(74) *Attorney, Agent, or Firm* — Vorys, Sater, Seymour and Pease LLP

(57) ABSTRACT

A panel for an oven includes a flat portion having a first surface that can face a cooking space of an oven and a second surface that can face a fan of the oven; the flat portion also having an opening for the transit of air; a frustoconical body fixed to the second surface at the periphery of the opening and having a plurality of holes; a deflector placed at the frustoconical body opposite the flat portion.

18 Claims, 5 Drawing Sheets

OVEN PANEL

CROSS-REFERENCE TO RELATED APPLICATIONS

This is a §371 National Stage Application of International Application No. PCT/IB2013/059878 filed on Nov. 11, 2013, claiming the priority of Italian Patent Application No. MI2012A001879 filed on Nov. 5, 2012.

The present invention has as object a panel for an oven. In particular, the present invention has as object a panel for an oven for ventilated cooking.

The present invention is applied in ventilated ovens for separating a cooking space of the oven from a space where a fan is housed, e.g. centrifugal or axial fan, for moving the hot air in the cooking space.

Typically, the present panel is applied between the fan and the cooking zone.

In the attempt to reduce the energy consumptions of the ventilated ovens, the fans and the employed ventilating system must have increasingly higher performances, in a manner so as to generate an effective air flow without energy waste.

In particular, the object of the present invention is to provide an oven panel which allows increasing the efficiency of the oven in a simple manner.

The specific technical task and object are substantially achieved by an oven panel comprising the technical characteristics set forth in one or more of the enclosed claims.

Further characteristics and advantages of the present invention will be clearer from the exemplifying and non-limiting description of a preferred but not exclusive embodiment of an oven panel, as illustrated in the enclosed drawings in which.

Figure 1:
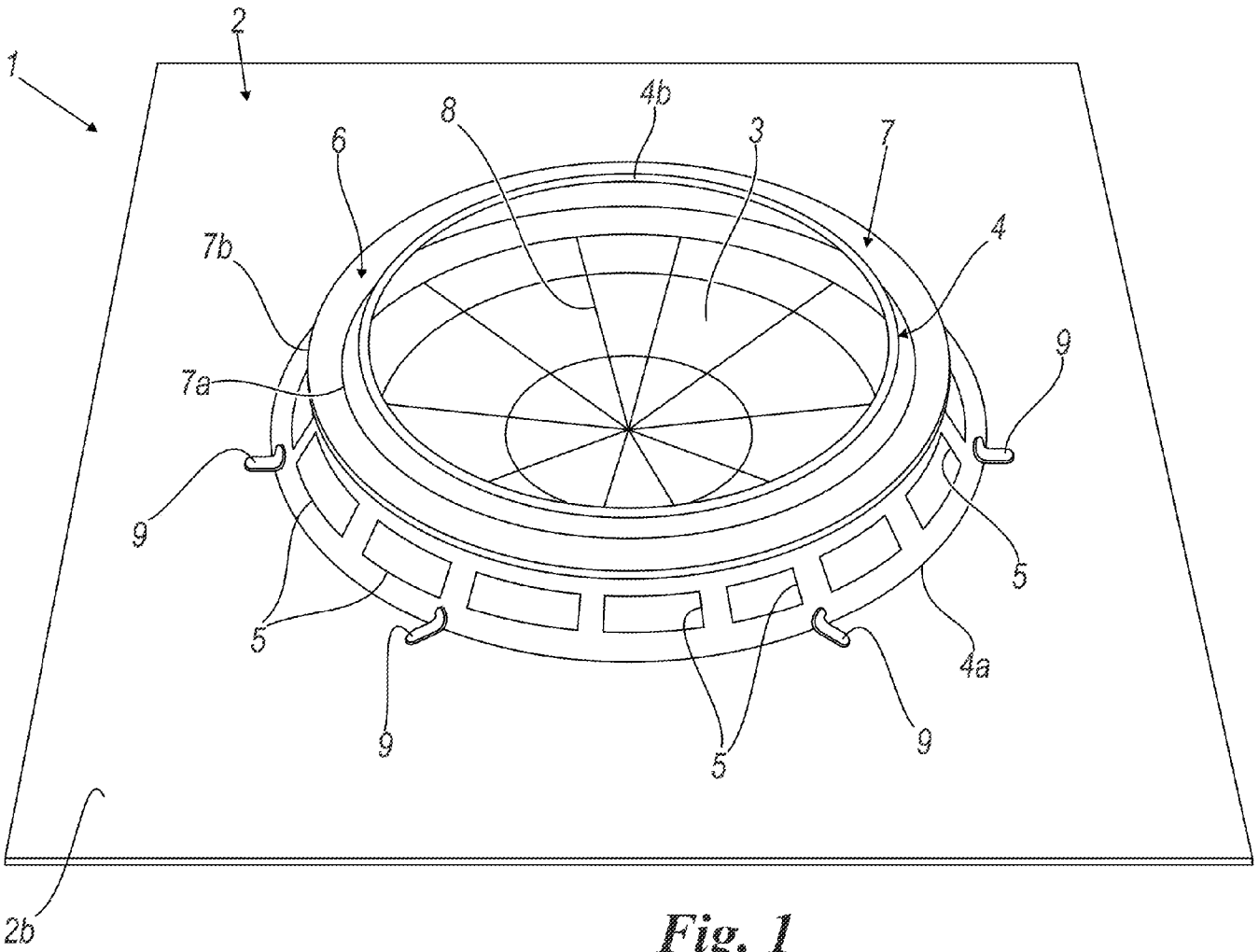
FIG. 1 is a perspective view of an oven panel in accordance with the present invention.
Figure 2:
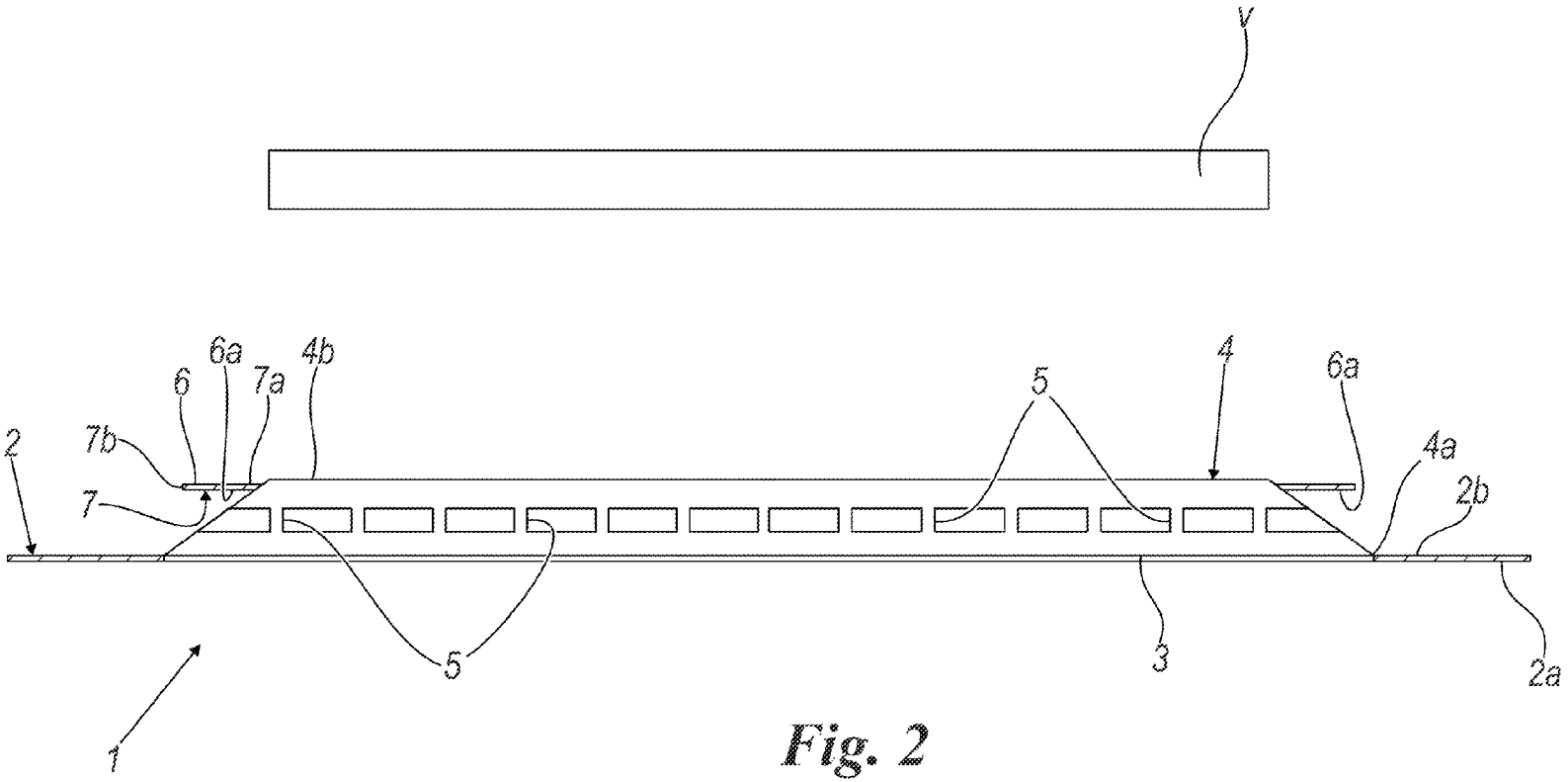
FIG. 2 is a section view of the panel of FIG. 1.

With reference to the enclosed figures, reference number 1 indicates overall a panel for an oven in accordance with the present invention.

The panel 1 comprises a flat portion 2 which has a shape substantially analogous to that of a space inside an oven, where the panel is mounted.

In detail, the flat portion 2 has substantially rectangular form.

The flat portion 2 has a first surface 2*a* facing, when the panel 1 is mounted in the oven, a cooking space of the oven. In addition, the flat portion 2 has a second surface 2*b* facing, when the panel 2 is mounted in the oven, a fan V of the oven itself.

Preferably, the flat portion 2 defines a clear and complete separation between the cooking space of the oven and a housing space for the fan V.

The flat portion 2 has an opening 3 arranged substantially at the center of the flat portion 2 in order to allow the transit of a flow of a fluid, which can be air and/or vapor and/or water, from the cooking space towards the fan V.

Preferably, in accordance with that illustrated, the opening 3 has circular form.

In any case, the diameter of the opening 3 depends on the diameter of the fan "V" intended to be employed, as well as on the size of the oven.

In alternative, non-illustrated embodiments, the opening can have any shape, such as square, rectangular or polygonal shape in general.

In accordance with that illustrated, the opening 3 is covered by a grate 8 for limiting the access from the cooking space to the fan V.

A hollow frustoconical body 4 is fixed to the flat portion 2 at the first surface 2*a* and, with reference to the panel 1 mounted in the oven, is extended towards the fan V.

The frustoconical body 4 is fixed to the flat portion 2 by means of coupling brackets 9 welded both to the flat portion 2 and to the frustoconical body 4 itself.

Alternatively, the frustoconical body 4 is obtained in one piece with the flat portion 2.

The frustoconical body 4 has a larger base 4*a* fixed to the flat portion 2 and a smaller base 4*b* opposite the greater base 4*a* and proximal to the fan V.

In other words, the frustoconical body 4 is tapered from the flat portion 2 towards the fan V. Advantageously, the frustoconical body 4 allows a channeling and an acceleration of the air flow from the cooking space towards the fan V.

Figure 3:
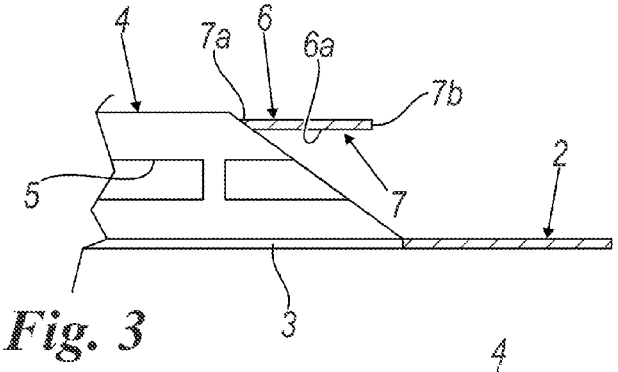
FIG. 3 is a view of a detail of the section of FIG. 2.

Preferably, as illustrated in FIG. 3, the frustoconical body 4 has a straight longitudinal form in section. By "longitudinal section", it is intended a section defined by a plane passing through the central axis of the frustoconical body 4.

In other words, the frustoconical body 4 illustrated in FIG. 3 is defined by a generatrix constituted by a straight segment placed in rotation around the central axis.

In further embodiments, the frustoconical body 4 can have further forms.

Figure 5:
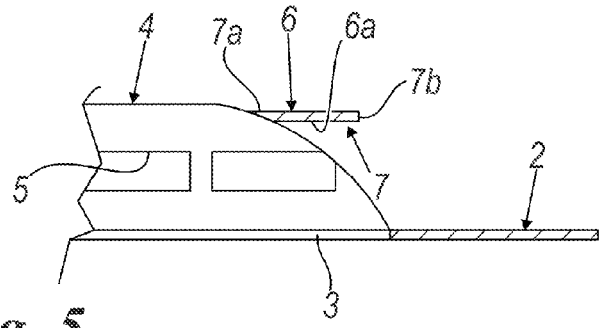
Figure 6:
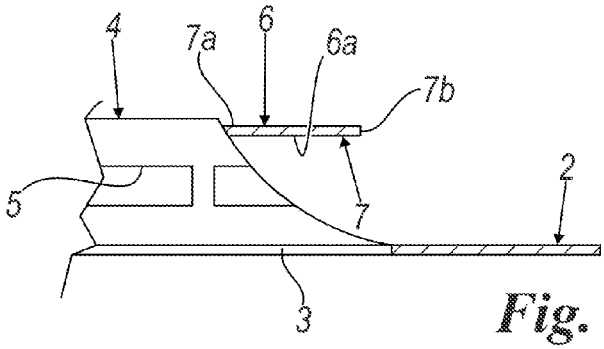

For example, the frustoconical body 4 can have, in longitudinal section, convex curved form (with reference to an external surface of the body, see FIG. 5) or concave curved form (with reference to an external surface of the body, see FIG. 6).

Figure 7:
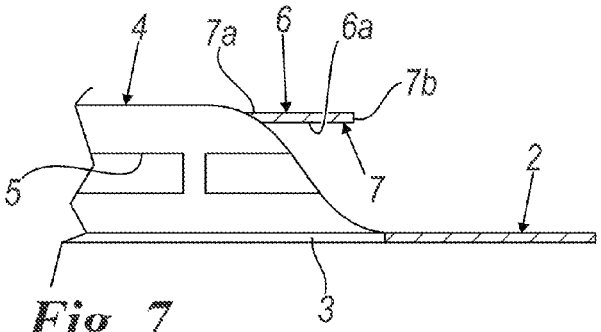
Figure 8:
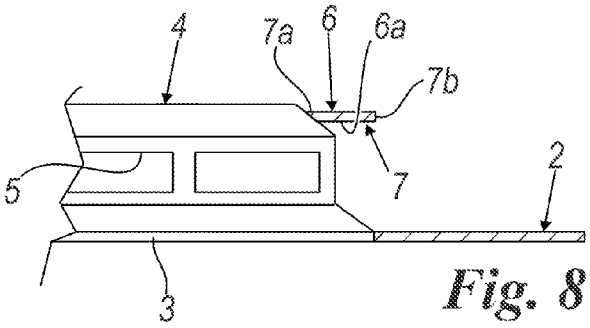

In addition, the generatrix of the frustoconical body 4 can be a jagged line or an S-shaped curved line (respectively FIGS. 8 and 7).

In any case, the frustoconical body 4 defines an empty space at its interior that is destined to remain such. In other words, the frustoconical body 4 is not destined to house the fan V.

The frustoconical body 4 has a plurality of holes 5 for the transit of air.

According to that illustrated, the holes 5 are all equivalent to each other, with regard to size and shape, and are equidistant from each other.

In alternative embodiments, the holes 5 can also be at random distances that are different from each other.

In the illustrated embodiment, the holes are rectangular and arranged along a single circular row.

In alternative embodiments, the holes 5 can have circular, elliptical, square, rhomboid or trapezoidal form, or they can be cross-shaped, S-shaped or C-shaped. In still other embodiments, the holes can be different from each other. For example, there can be two or more forms alternated with each other.

Figure 4:
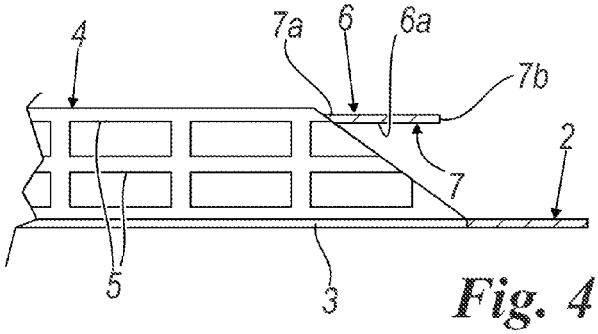
FIGS. 4-12 are section views of respective embodiment variants of the detail of FIG. 3.

The holes 5 can also be arranged on two rows that are close to each other (FIG. 4).

In further non-illustrated embodiments, the holes are not completely equidistant, but are grouped in groups of preferably equidistant holes, arranged on separate angular areas of the frustoconical body.

Purely by way of example, the holes can be limited at the perforation zones, angularly spaced 90° from each other. In accordance with the present invention, the panel 1 comprises a deflector 6 fixed in proximity to one end of the frustoconical body 4 opposite the flat portion 2.

In other words, the deflector 6 is fixed to the frustoconical body 4 in proximity to the smaller base 4*b*. In the illustrated embodiment, the deflector 6 is fixed to the frustoconical body 4 in a manner such that the frustoconical body 4 projects from the deflector 6.

The deflector 6 transversely deflects the air flow that is sucked through the opening 3. In detail, the deflector 6 transversely deflects the air flow portion that moves through the opening and through the holes 5.

The flow portion deflected by the deflector 6 is rejoined with the main flow sucked by the fan V and transversely centrifuged by the same.

This allows a considerable increase of the efficiency of the ventilation, given the same fan V used.

In more detail, the deflector 6 has a flat surface 6*a* directed towards the flat portion 2. In such a manner, the flat surface 6*a* is transversely facing the frustoconical body 4 and the holes 5 in order to deflect the flow moving through the aforesaid holes 5.

According to that illustrated, the deflector 6 is a ring 7 applied to the smaller base 4*b* and projecting externally. In accordance with that illustrated, the ring 7 is circular. The ring 7 is fixed to the smaller base 4*b* of the frustoconical body 4 at an internal circumference 7*a* thereof.

Alternatively, the ring 7 of the deflector 6 is obtained in a single piece with the frustoconical body 4, projecting externally from the smaller base 4*b*.

Figure 9:
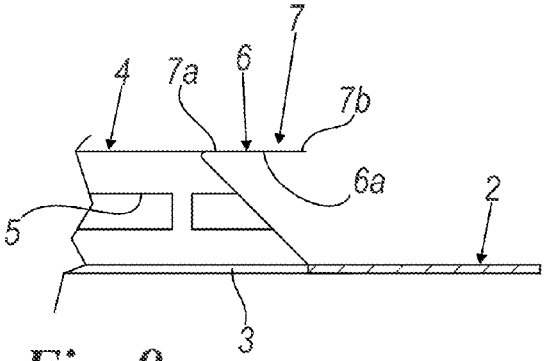
Figure 10:
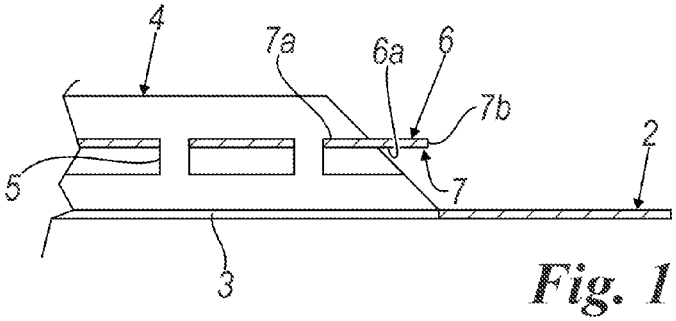
Figure 11:
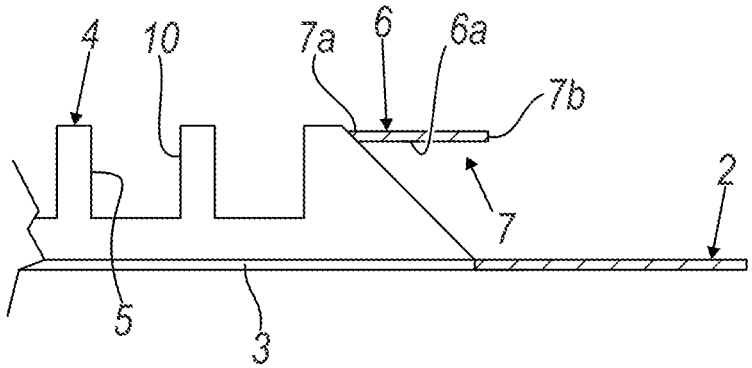
Figure 12:
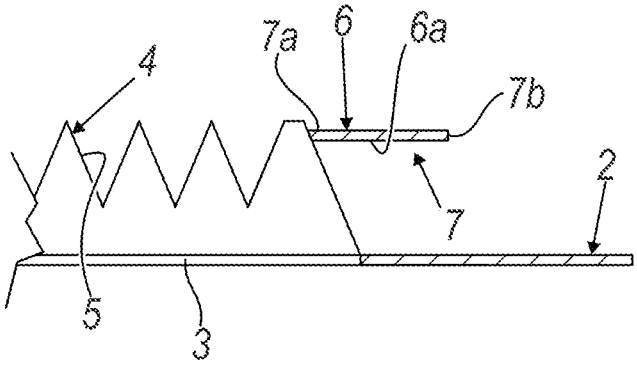

With reference to FIG. 9, the ring 7 of the deflector 6 is obtained by bending a projecting portion of the frustoconical body 4. In such case, the ring 7 is exactly fixed to the smaller base 4*b* of the frustoconical body 4. In the embodiment illustrated in FIG. 10, the holes 5 (of any form) are obtained by partially cutting the frustoconical body 4 and bending the cut edges in a manner such that they lie parallel to the flat portion 2. The edges thus bent define the ring 7 of the deflector 6. In the embodiments illustrated in FIGS. 11 and 12, the frustoconical body 4 has notches 10 that are extended from the smaller base 4*b* towards the larger base 4*a*.

Once the ring 7 is applied, the portion of the notches 10 comprised between the ring 7 itself and the flat portion 2 defines the holes 5.

The notches 10 can have a plurality of forms. By way of example, they can have square or rectangular form (FIG. 11), triangular form (FIG. 12), trapezoidal form, rounded form or yet another form.

The width of the ring 7 defined between its internal circumference 7*a* and an external circumference 7*b* is constant.

The width of the ring 7 is comprised between 1 mm and 40 mm, preferably comprised between 1 mm and 35 mm.

The internal circumference 7*a* is comprised between 330 mm and 390 mm.

In any case, the measurement of the internal circumference 7*a* and the measurement of the external circumference 7*b* are selected as a function of the diameter of the fan "V".

In alternative embodiments, the ring 7 can have different forms corresponding to the form of the opening 3.

Preferably, the ring 7 is flat and it is arranged parallel to the flat portion 2.

The invention attains the pre-established object.

Indeed, the deflection of the air flow that moves through the holes of the frustoconical body allows an acceleration of the overall flow of the air sucked by the fan.

In such a manner, the performances increase, independent of the fan itself.

The invention claimed is:

1. A panel for an oven comprising:

a flat portion having a first surface that can face a cooking space of an oven and a second surface that can face a fan of said oven; said flat portion also having an opening for the transit of fluid;

a frustoconical body fixed to the second surface at the periphery of said opening and having a plurality of holes;

wherein the panel also comprises a deflector arranged at the frustoconical body opposite the flat portion;

wherein said frustoconical body is fixed to the flat portion at a larger base thereof.

2. A panel for an oven comprising:

a flat portion having a first surface that can face a cooking space of an oven and a second surface that can face a fan of said oven; said flat portion also having an opening for the transit of fluid;

a frustoconical body fixed to the second surface at the periphery of said opening and having a plurality of holes;

wherein the panel also comprises a deflector arranged at the frustoconical body opposite the flat portion;

wherein said deflector has at least one flat surface facing said flat portion in order to transversely deflect a flow of air in transit from the opening.

3. A panel for an oven comprising:

a flat portion having a first surface that can face a cooking space of an oven and a second surface that can face a fan of said oven; said flat portion also having an opening for the transit of fluid;

a frustoconical body fixed to the second surface at the periphery of said opening and having a plurality of holes;

wherein the panel also comprises a deflector arranged at the frustoconical body opposite the flat portion;

wherein said deflector is a circular ring fixed to the frustoconical body.

4. The panel according to claim 2, wherein said ring is substantially parallel to said flat portion.

5. The panel according to claim 2, wherein said frustoconical body is fixed to the flat portion at a larger base thereof.

6. The panel according to claim 1, wherein the ring has a width comprised between 20 mm and 40 mm.

7. The panel according to claim 1, wherein the holes on the frustoconical body are equivalent to each other and equidistant.

8. The panel according to claim 1, wherein the holes on the frustoconical body are arranged at mutually different distances.

9. The panel according to claim 1, wherein said holes have square and/or rectangular and/or circular and/or triangular shape.

10. The panel according to claim 1, wherein said frustoconical body has straight or concave curved or convex curved form in longitudinal section.

11. The panel according to any claim 1, wherein the ring has a width comprised between 25 mm and 35 mm.

12. The panel according to claim 3, wherein said frustoconical body is fixed to the flat portion at a larger base thereof.

13. The panel according to claim 2, wherein said ring is substantially parallel to said flat portion.

14. The panel according to claim 2, wherein the ring has a width comprised between 20 mm and 40 mm.

15. The panel according to claim 2, wherein the holes on the frustoconical body are equivalent to each other and equidistant.

16. The panel according to claim 3, wherein said ring is substantially parallel to said flat portion.

17. The panel according to claim 3, wherein the ring has a width comprised between 20 mm and 40 mm.

18. The panel according to claim 3, wherein the holes on the frustoconical body are equivalent to each other and equidistant.

* * * * *